US005219205A

United States Patent [19]

Fourrey et al.

[11] Patent Number: 5,219,205

[45] Date of Patent: Jun. 15, 1993

[54] ENVELOPING COVERING FOR A SEAT, AND ITS APPLICATION TO VEHICLE SEATS

[75] Inventors: Francois Fourrey, Montbeliard; Frédéric Baret, Belfort; Roel Verhoog, Valentigney, all of France

[73] Assignee: Cesa-Compagnie Europenne De Sieges Pour Automobiles, France

[21] Appl. No.: 795,546

[22] Filed: Nov. 21, 1991

[30] Foreign Application Priority Data

Dec. 3, 1990 [FR] France ..... 9015113

[51] Int. Cl.[5] ..... A47C 7/02

[52] U.S. Cl. ..... 297/459; 297/456

[58] Field of Search ..... 297/459, 719, 225, 229, 297/216, 383, DIG. 1, 284 G, 218, 312, 455, 456, 459, 460, 407, 391

[56] References Cited

U.S. PATENT DOCUMENTS

| | | | |
|---|---|---|---|
| 4,607,887 | 8/1986 | Vail | 297/459 X |
| 4,740,035 | 4/1988 | Kazaoka et al. | 297/218 X |
| 4,883,320 | 11/1989 | Izumida et al. | 297/459 X |
| 5,022,709 | 6/1991 | Marchino | 297/460 X |

FOREIGN PATENT DOCUMENTS

| | | | |
|---|---|---|---|
| 2615714 | 12/1988 | France . | |
| 990112 | 4/1967 | United Kingdom | 297/219 |
| 2154446 | 9/1985 | United Kingdom . | |

*Primary Examiner*—Kenneth J. Dorner
*Assistant Examiner*—James M. Gardner
*Attorney, Agent, or Firm*—Sughrue, Mion, Zinn, Macpeak & Seas

[57] ABSTRACT

The covering (20) for a seat, made from an outer envelope (21) and an inner padding (22) shaped into a central pad (221) bordered by two side wings (222), where the pad (221) and wings (222) are arranged so as to form a pan (200), the concavity of which is intended to receive an occupant, where the padding (22) takes the form of a unit (30) consisting of comprising two elements (31, 32) separated by a joining surface (300), and where that one (31) of these elements (31, 32) which is closes to the pan (200) is made from a material which has a softer consistency than that of the material of the other one (32) of these elements (31, 32), so that when the pan (200) of the padding receives an occupant, the force exerted on the covering (20) straight the pad (221) causes the wings (222) automatically to be brought closer to each other by pivoting about a hinge zone (3020), and vice versa.

9 Claims, 1 Drawing Sheet

ENVELOPING COVERING FOR A SEAT, AND ITS APPLICATION TO VEHICLE SEATS

BACKGROUND OF THE INVENTION

The present invention relates to seat coverings and in particular, coverings for seats of land motor vehicles of a type which at least locally provides a certain enveloping of the occupant seated therein.

In order to improve the comfort of their users, there is currently a move towards manufacturing seats which at least locally envelop certain parts of the body of the person seated thereon. This is in particular the case with seats for land motor vehicles.

So that an occupant of a so-called "touring" vehicle travelling at a relatively high speed remains firmly "wedged" on his seat when the vehicle takes a bend, there is a tendency towards giving the seat the configuration of a "bucket", drawing inspiration from the solutions adopted for racing vehicles. In order to obtain this configuration, the cushion, the squab and even the headrest are usually equipped with side flanges. It can be seen that the greater the size, and in particular the height, of such flanges as compared with the parts which they enclose of the cushion, the squab and possibly the headrest supporting the occupant, the better this occupant is wedged on his seat.

However, this solution is not without disadvantages, in particular for "touring" vehicles. Indeed, for these vehicles, the cushion of the seat is relatively close to the floor, and this floor is moreover very low owing to the adoption of a minimum ground clearance. It can be understood that it is then relatively inconvenient for an occupant to get into or get out of such a seat even if he manages to find a handhold to help his movement. In an attempt to overcome these types of difficulties, it was conceived to make these flanges movable, in particular the cushion flange closest to the sides of the vehicle, and to arrange for the opening or closing of a door automatically to cause this flange to pivot from an erect position, wedging the occupant, into a retracted position approximately level with the cushion in order to enable him to get into or out of the seat, and vice versa.

Although this type of solution is relatively satisfactory in practical terms, it is nevertheless complex, and hence expensive, and subject to risks of failure.

SUMMARY OF THE INVENTION

The object of the invention is to produce an enveloping covering for a seat of a relatively enveloping type, the enveloping function of which is accentuated automatically once an occupant sits on his seat and, conversely, is reduced when the occupant leaves his seat.

The subject of the invention is a seat covering made from an outer envelope and an inner padding shaped into a central pad bordered by two side wings, where this pad and these wings are arranged so as to form a pan, the concavity of which is intended to receive an occupant. This covering is notable, in particular, in that the pad takes the form of a unit comprising two elements separated by a joining surface which, in cross-section, has the configuration of a central bridging piece extended on each side by a trough consisting, in each case, of two arms connected by a base, the inner arm being joined to the bridging piece and the other, outer arm being connected to the base by a hinge zone, this bridging piece being aligned with this pad, and these troughs being aligned with these wings, and in that one of these elements which is closest to the pan is made from a material which has a softer consistency than that of the material of the other one of these elements, and in that this envelope covers entirely the element closest to the pan and at least the areas of the other element opposite this outer arm and this bridging piece, and is made from a virtually unstretchable material. The arrangement of this covering is such that when the pan of the padding receives an occupant, the force exerted on the covering straight the pad automatically causes the wings to be brought closer to each other by pivoting about the hinge zone, and the reverse takes place when the occupant leaves the padding.

Other features of the invention will become apparent upon reading the following description and claims, and from ex the attached drawing, given claims, and from examining the attached drawing, given purely by way of example, in which:

DESCRIPTION OF PREFERRED EMBODIMENTS

Figure 1:
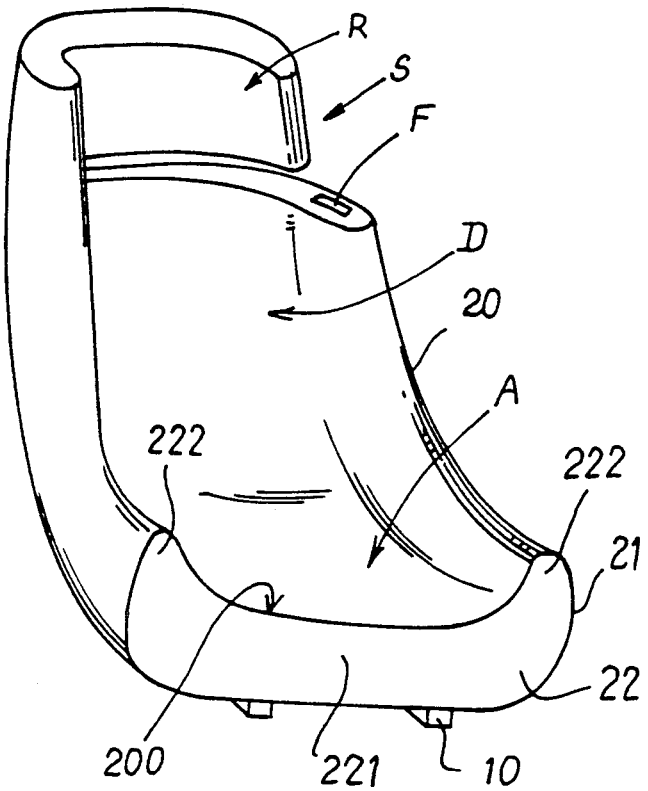
FIG. 1 is a diagrammatic perspective view of an embodiment of a seat according to the invention.

Since seats and their coverings, in particular for land motor vehicles, are well known from the prior art, only that which relates directly and indirectly to the invention will be explained. For the remainder, the person skilled in the art in question will draw from the current conventional solutions available to him in order to deal with the particular problems with which he is confronted.

In what follows a same reference numeral will always be used to identify an identical element, irrespective of the embodiment.

For the sake of convenience of the explanation, each of the components of a seat covering according to the invention will be described successively before explaining their functioning.

As can be seen, a seat S usually consists of a plurality of parts. These parts are a cushion A, a squab D and sometimes a headrest R.

Such a seat comprises a frame 10 and a covering 20. The covering 20 consists of an envelope 21 which serves as the trim and which at least partially covers a padding 22 which serves for the stuffing. As can be seen, the padding 22 is shaped into a central pad 221 bordered by two side wings 222.

Figure 3:
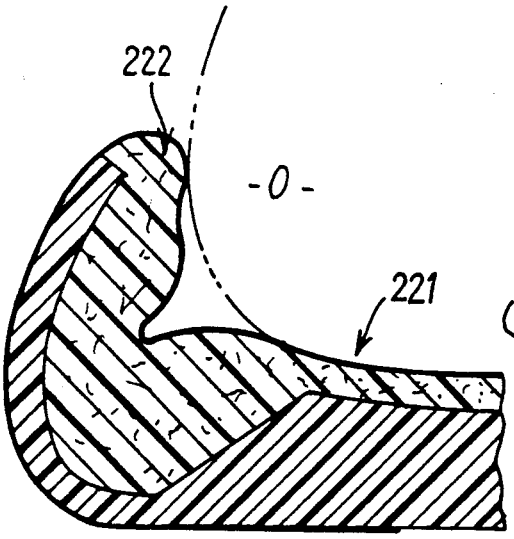
FIGS. 2 and 3 are partial cross-sections of such a covering illustrated respectively in the position assumed in the absence of an occupant and in the pressure of an occupant.
Figure 2:
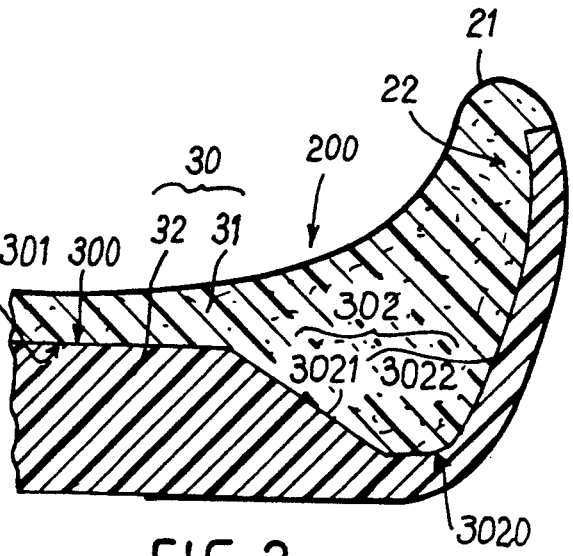

As may be observed by examining the partial cross-sections in FIGS. 2 and 3, the padding 22 takes the form of a unit 30 comprising two elements 31 and separated by a joining surface 300. As may be observed, in cross-section, the joining surface 300 has the configuration of a central bridging piece 301 extended on each side by a trough 302. Each of the troughs 302 comprises two arms 3021 connected by a base 3022. As can be seen in FIGS. 2 and 3 in particular, one of the arms 3021, the inner arm, adjoins the bridging piece 301, whilst the other arm 3021, the outer arm, is connected to the base 3022 by a hinge zone 3020. As can be seen, the bridging piece 301 is aligned with the pad 221, and each of the troughs 302 is aligned with the corresponding wing 222.

As may be observed, the pad 221 and the wings 222 are arranged so as to form a pan 200, the concavity of which is intended to receive an occupant 0. The element 31 closest to the pan is made from a material which has a softer consistency than that of the material of the element 32 associated therewith.

As may be observed from FIGS. 2 and 3, the envelope 21 covers virtually all of the element 31 closest to the pan, and also covers at least the areas of the element 32 which are opposite each of the outer arms 3021 and the bridging piece 301. This envelope is made from a virtually unstretchable material.

In the normal state, in the absence of any occupant, a seat covering according to the invention is in the state in which it is illustrated in FIGS. 1 and 2.

In the occupied state, in the presence of a user, the seat covering according to the invention occupies the situation in which it is illustrated in FIG. 3. It can be seen that when the pan of the padding receives an occupant, the force exerted on the covering straight above the pad 221 causes the wings 222 automatically to be brought towards each other by pivoting about the hinge zone 3020; and conversely these wings move apart from each other by spontaneous pivoting about this hinge zone owing to the relatively elastic properties adopted for the materials of the two elements 31 and 32 and for the material of the envelope 21, when the occupant leaves the seat.

The element 32 is preferably made from a foam of standard hardness which is usually used for seat cushions, whereas the material chosen for the element 31 is a very soft foam, in any case softer than that for traditional cushions. Consequently, it can be seen that the element 31 is shaped around the occupant, whilst the element 32 provides the dynamic comfort of the padding and rigidifies the outer part of the wings.

For example, by way of a guide, for the "soft" element 31, a foam is selected which is crushed between 2 and 7 kPa, and for the "hard" element 32 a foam which is crushed between 7 and 12 kPa. These values are determined according to the practice which characterises the flexibility of a padding by the pressure required to crush the stuffing, usually foam, by 50% in compression on the fifth compaction.

When an occupant sits down on the seat, the areas of the element 31 which are adjacent to the inner arms 3021 are compressed and, via the envelope 21, pull on the top of each of the wings 222. These wings 222, the outer areas of which opposite each of the outer arms 3021 are relatively rigidified by the element 32 made from a "harder" material, tend to move as one, pivoting about the hinge zone 3020. This pivoting causes each wing to envelop part of the occupant, for example his thighs for the cushion, his back and his shoulders for the squab, and even his head for the headrest.

Depending upon the embodiment adopted, the envelope 21 is a "skin" automatically formed over the foam of the elements 31 and 32, or alternatively a "skin" fitted over the padding 22.

The covering according to the invention is suitable for seats in which the frame is external, or alternatively at least partially incorporated into the covering.

Similarly, a covering according to the invention makes it possible to incorporate an inertia-reel seatbelt into the seat. In such a case, the strap of the seatbelt emerges through a slot F.

All the advantages provided by the seat covering according to the invention can thus be appreciated.

What is claimed is:

1. A seat covering (20) consisting only of an outer envelope (21) and an inner padding (22) that is shaped into a central pad (221) bordered by two side wings (222), wherein said central pad (221) and said side wings (222) form a pad (200) having a central concavity adapted to receive an occupant;

wherein said inner padding (22) is in the form of a unit (30) comprising a first foam element (31), which is adjacent to said pan (200) and which is made of a first foam material having a first consistency, and a second foam element 32) which is remote from said pan (200), which adjoins said first foam element and which is made of a second foam material that has a second consistency which is not as soft as said first consistency;

wherein said first (31) and second (32) foam elements are separated by a joining surface (300) which in cross sections has a configuration of a central bridging piece (301) extended on two opposite sides thereof by respective troughs (302) each of which has an inner arm and an outer arm that are interconnected by a base (3022), only each said outer arm being connected to its respective said base (3022) by an hinging zone (3020); wherein said bridging piece (301) is aligned with said central pad (221), and each of said troughs (302) is aligned with a responsive one of said side wings (222);

wherein said outer envelope (21) entirely covers said first foam element (31) and covers at least some areas of said second foam element (32) that face said outer arms and said bridging piece (301), said outer envelope (21) being made of a virtually unstretchable material;

wherein, when said pan (200) of said inner padding (22) receives an occupant, a resulting force exerted on that portion of said covering (20) which faces said central pad (221) automatically causes said wings (222) to move toward each other by pivoting of each wing about its respective said hinging zone (3020) to assume an occupied state; and wherein, when said pan is unoccupied, said wings automatically pivot away from each other to assume a normal state.

2. The covering according to claim 1, wherein said first foam material has a crushing strength of the order of 2 to 7 kPa, and the other said second foam material has a crushing strength of the order of 7 to 12 kPa.

3. The covering according to claim 1 or 2, characterised in that the envelope (21) is a "skin" automatically formed over said first and second foam elements (31,32).

4. The covering according to claim 1 or 2, characterised in that the envelope (21) is fitted over the inner padding (22).

5. The covering (20) according to claim 1, wherein said pan is a cushion (A) of a motor vehicle seat (S).

6. The covering according to claim 1, wherein said pan is a squad (D) of a motor vehicle seat.

7. The covering according to claim 1, wherein said pan is a headrest (R) of a motor vehicle seat.

8. The covering according to claim 1, wherein said seat is a motor vehicle seat.

9. Method of using a seat covering as a covering for a motor vehicle seat (S), wherein said seat covering (20) consisting only of an outer envelope (21) and an inner padding (22) that is shaped into a central pad (221) bordered by two side wings (222), wherein said central pad (221) and said wings (222) form a pad (200) having a central concavity adapted to receive an occupant;

wherein said inner padding (22) is in the form of a unit (30) comprising a first foam element (31), which is adjacent to said pan (200) and which is made of a first foam material having a fist consistency, and a second foam element (32) which is remote from said pan (200), which adjoins said first foam element and which is made of a second foam material that has a second consistency which is not as soft as said first consistency;

wherein said first (31) and second (32) foam elements are separated by a joining surface (300) which in cross section has a configuration of a central bridging piece (301) extended on two opposite sides thereof by respective troughs (302) each of which has an inner arm and an outer arm that are interconnected by a base (3022), only each said outer arm being connected to its respective said base (3022) by a hinging zone (3020); wherein said bridging piece (301) is aligned with said central pad (221), and each of said troughs (302) is aligned with a respective one of said side wings (222);

wherein said outer envelope (21) entirely covers said first foam element (31) and covers at least some areas of said second foam element (32) that face outer arms and said bridging piece (301), said outer envelope (21) being made of a virtually unstretchable material;

wherein, when said pan (200) of said inner padding (22) receives an occupant, a resulting force exerted on that portion of said covering (20) which faces said central pad (221) automatically causes said wings (222) to move toward each other by pivoting of each wing about its respective said hinging zone (3020) to assume an occupied state; and wherein, when said pan is unoccupied, said wings automatically pivot away from each other to assume a normal state.

* * * * *